United States Patent [19]

Roberts

[11] 4,402,131

[45] Sep. 6, 1983

[54] ELECTRICAL SWITCH ASSEMBLY AND METHOD OF MANUFACTURE

[75] Inventor: Joseph A. Roberts, Hudson, N.H.

[73] Assignee: Advanced Circuit Technology, Nashua, N.H.

[21] Appl. No.: 318,202

[22] Filed: Nov. 4, 1981

Related U.S. Application Data

[63] Continuation-in-part of Ser. No. 290,220, Aug. 5, 1981, which is a continuation-in-part of Ser. No. 216,162, Dec. 15, 1980.

[51] Int. Cl.[3] ..... H01H 11/04

[52] U.S. Cl. ..... 29/622; 29/847; 200/159 R; 200/283; 200/292

[58] Field of Search ..... 29/622, 846, 847, 848; 200/5 A, 16 A, 86 R, 61.12, 159 B, 159 R, 159 A, 292, 283, 278, 302

[56] References Cited

U.S. PATENT DOCUMENTS

| | | | |
|---|---|---|---|
| 2,367,441 | 1/1945 | Schwinn . | |
| 3,209,089 | 9/1965 | Weissburg | 200/16 |
| 3,294,927 | 12/1966 | Hill | 200/5 |
| 3,396,457 | 8/1968 | Nordin | 29/622 |
| 3,399,452 | 9/1968 | Reid | 29/622 |
| 3,681,723 | 8/1972 | Goll | 335/207 |
| 3,786,205 | 1/1974 | Lien | 200/5 A |
| 3,860,771 | 1/1975 | Lynn et al. | 200/5 A |
| 3,987,259 | 10/1976 | Larson | 200/5 A |
| 4,032,729 | 6/1977 | Koistinen | 200/5 A |
| 4,180,711 | 12/1979 | Hirata et al. | 200/5 A |

FOREIGN PATENT DOCUMENTS

| | | |
|---|---|---|
| 250292 | 4/1960 | Netherlands . |
| 711647 | 7/1954 | United Kingdom . |
| 898413 | 3/1960 | United Kingdom . |
| 957801 | 5/1964 | United Kingdom . |
| 1062938 | 3/1967 | United Kingdom . |
| 1169037 | 10/1969 | United Kingdom . |
| 1246933 | 9/1971 | United Kingdom . |
| 1474858 | 5/1977 | United Kingdom . |

OTHER PUBLICATIONS

Holland, L. and Petersen, K. E., "Bottom Contact Micromechanical Switching Geometry", IBM Tech. Disclosure Bull., vol. 21, #3, pp. 1207–1208, Aug. 1978.

IBM Technical Disclosure Bulletin, vol. 13, No. 7, Dec., 1970.

IBM Technical Disclosure Bulletin, vol. 19, No. 10, Mar., 1977.

*Primary Examiner*—Carl E. Hall
*Assistant Examiner*—P. W. Echols
*Attorney, Agent, or Firm*—Hayes, Davis & Soloway

[57] ABSTRACT

The present invention provides low cost electrical switch assemblies and methods for manufacturing same. The switch assembly comprises an array of resiliently flexible metallic conductors arranged in predetermined circuit pathways on a dielectric carrier panel. A plurality of apertures or cavities are provided at predetermined locations in the carrier panel. The switch contacts comprise a pair of generally L-shaped fingers which are integral extensions of the flexible conductors. The fingers extend from opposite edge surfaces of the carrier panel defining an associated aperture or cavity, to pass one another over or within their associated aperture or cavity, with the free ends of the fingers terminating adjacent one another. The free ends of the L-shaped fingers extend in part above or below the plane of the carrier panel, and are positioned in spaced relationship to one another so that the conductors they connect are normally open, but are sufficiently close to one another so that slight deflection of the fingers from their normal orientation moves the free ends in contact with each other to thereby close the switch. Alternatively, the free ends of the L-shaped fingers are positioned in contact with one another so that slight deflection of the fingers from their normal orientation breaks their contact. The metallic conductors and integral switch contacts may be formed by photoimaging and either chemical milling or additive techniques such as plating up or solder doming, and/or mechanical milling and/or precision die stamping techniques.

27 Claims, 28 Drawing Figures

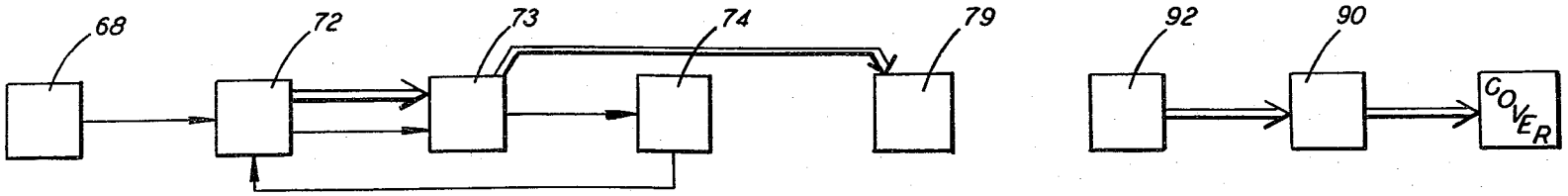
FIG. 5
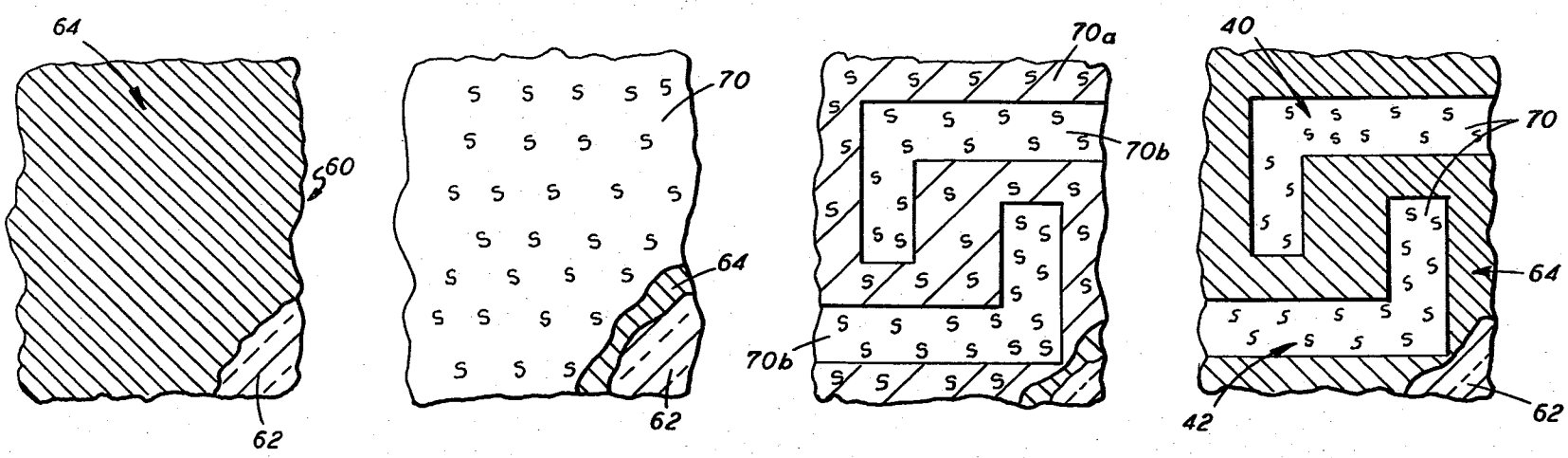
FIG. 6a
FIG. 6b
FIG. 6c
FIG. 7

ELECTRICAL SWITCH ASSEMBLY AND METHOD OF MANUFACTURE

CROSS-REFERENCES TO RELATED APPLICATIONS

The present application is a continuation-in-part of my copending application Ser. No. 290,220, filed Aug. 5, 1981, which application in turn is a continuation-in-part of my copending application Ser. No. 216,162, filed Dec. 15, 1980.

BACKGROUND OF THE INVENTION

1. Field of the Invention

This invention relates generally to electrical switch assemblies, and more particularly to improved switch assemblies comprising a plurality of switches in a predefined arrangement, and to methods for manufacturing such switch assemblies. The invention has particular utility in connection with keyswitches in a keyboard assembly and will be described in connection with such utility.

2. Description of the Prior Art

Electrical switch assemblies for sensing the activation of keys in a keyboard system and for producing signals representative of keyboard activations are well known in the art. In general, prior art keyboard switches comprise a circuit board having a plurality of discontinuous, conductive pathways, separate from one another, on one or both surfaces thereof, and a plurality of switching means for selectively, electrically connecting the pathways, carried on one surface of the board. Typically the switching means comprise individual contact elements supported in a plane remote from that of the circuit board, and spaced from the conductive pathways. Resilient spring means are provided for maintaining the contact elements in the remote plane so that the individual switches are normally open. For example, Robinson et al. U.S. Pat. No. 4,018,999 disclose a keyboard switch assembly comprising a plurality of switches in a predefined arrangement formed on one face of an insulative circuit board, and having a protective insulative coating located over the entire circuit board to retain the switches on the board, and also to seal the switches. According to Robinson et al each switch has an annular outer contact and a concentric inner contact, and includes a resiliently deformable, dome-shaped activating element. The activating element has an annular marginal edge which is shaped to coincide with the outer contact and is positioned on top of the outer contact to protrude therefrom. In operation, a downward force is applied to the upwardly protruding portion of the actuating element so that the element is deformed downwardly and touches the inner contact, thereby completing an electrical circuit between the inner and outer contacts.

Another type keyboard switch is disclosed in Webb et al. U.S. Pat. No. 3,653,038. Webb et al. disclose a snap action capacitive electric signal device which may be used as a switch. The basic structure comprises a metallic target which forms one "plate" of the capacitor. Located near the target and separated therefrom by air is a dome spring which forms the other plate of the capacitor. Located adjacent the dome spring and axially aligned therewith is a depressible button or key. The dome spring and associated depressible button are maintained in place in registration in suitably located circular apertures formed in a central insulating support board or guide plate.

Still other variations of keyboard switches are disclosed in Wiener U.S. Pat. No. 3,383,487, Sudduth U.S. Pat. No. 3,699,294, Seeger, Jr. et al. U.S. Pat. No. 3,789,167, Lynn et al. U.S. Pat. No. 3,860,771, Flint et al. U.S. Pat. No. 4,083,100, Pounds U.S. Pat. No. 4,042,439, Dunlap U.S. Pat. No. 4,085,306, Pounds et al. U.S. Pat. No. 4,195,210, Satoh U.S. Pat. No. 4,218,603, Kissner, U.S. Pat. No. 4,218,600 and Johnson U.S. Pat. No. 4,254,309.

Manufacturing keyboard switches of the above described prior art types is relatively expensive. Such prior art types require a number of parts which must be separately manufactured and inventoried. Also, accurate positioning of the various actuating members with respect to their associated contacts present manufacturing problems. With respect to the positioning problems the art has proposed certain solutions; however, as reported by Flint et al. in U.S. Pat. No. 4,083,100, existing solutions to such positioning problems either have proved too inaccurate, or have required complex and expensive equipment. For example, Robinson et al. have suggested that the actuating members may be initially oriented with respect to the circuit board by means of an appropriate template. However, before the insulation sheet can be secured over the circuit board the template has to be removed. This presents a problem since the activating members have to be retained in place independently of the template once they are positioned with respect to the circuit board. In order to solve this latter problem Robinson et al. propose assembling the actuating members to the circuit board on a specially designed transfer base. The latter is constructed to receive the circuit board and to retain the domes with respect thereto by means of an externally applied vacuum or by means of magnet members. As will be appreciated, the transfer base not only constitutes an additional complication and expense in the assembly process, but also introduces difficulties in accurate alignment, because the transfer base, the circuit board and the template all have to be aligned accurately. Also, when the template is removed, the actuating members are in an exposed position with respect to the circuit and although restrained with respect to the circuit board, could be damaged or accidentally moved out of position during assembly. Also, the insulation sheet necessarily is placed on top of the circuit board and actuating members prior to being secured thereto, and, in being moved about, could accidentally displace one or more actuating members. Moreover, with this technique the insulation sheet is supported only on the tops of the actuating members and is not held flat immediately prior to being secured to the board. Thus, creases or similar inperfections in the insulation sheet material near the perimeter of an actuating member might not be secured to the board and thereby would permit some movement of the actuating member. As a result of the actuating member could move with respect to the circuit board during separation, so that, even though accurately positioned initially, the actuating member could move out of position during use. The foregoing and other limitations of positioning accuracy, manufacturing convenience, switch reliability and manufacturing cost are believed inherent in many prior art keyboard switch assemblies and the manufacture of such switch assemblies. Moreover many prior art keyboards are believed to be prone to failure in the field due to mechanical and/or electrical breakdown. With regard to this latter problem, it has thus become a common practice in the art to plate switch contacting members with a non-corrosive metal such as gold. Such plating requirements add significantly to manufacturing costs. Moreover, the inter-connections may also be subject to degradation due to metal loss from the switch contacting members upon repeated mating and unmating interconnections.

It is thus a principal object of the present invention to provide a novel and improved electrical switch assembly which overcomes the aforesaid and other problems of the prior art. Yet other objects of the present invention are to provide highly reliable electrical switches, particularly for use in keyboard applications, and low-cost methods for producing electrical switches of the type above described. Still more specific objects are to provide novel and improved keyboard switches which are characterized by extreme reliability, and low-cost method for producing custom switch patterns.

SUMMARY OF THE INVENTION

Generally, the present invention provides an electrical switch assembly which essentially comprises a dielectric carrier panel carrying an array of resilient flexible electrically conductive conductors defining one or more circuit pathways, and including switch contacts which are integral extensions of the circuit pathways. The dielectric carrier panel has a plurality of apertures or cavities at predetermined locations in the carrier panel, and the switch contacts are positioned to lie at least in part over or within the apertures or cavites. The switch contacts comprise a pair of generally "L-shaped" or "golf-club shaped" fingers. The L-shaped fingers extend from opposite edge surfaces of the carrier panel defining an associated aperture or cavity, to pass one another over or within their respective aperture or cavity, with the free ends of the fingers terminating adjacent one another. The free ends of the L-shaped fingers are positioned in spaced relationship to one another so that the circuit pathways they connect are normally open, but are sufficiently close to one another so that slight deflection of the fingers from their normal position relative to the surface of the carrier panel moves the free ends in contact with each other to thereby close the switch. Alternatively, the free ends of the L-shaped fingers may be positioned in contact with one another so that slight deflection of the fingers from their normal position breaks their contact. In a preferred embodiment of the invention the switch assembly also includes a protective overlay covering the conductors and switch contacts at least in part, formed of flexible dielectric sheet material and including molded actuation elements which overlie the switch contacts. The array of electrically conductive conductors and integral switch contacts may be formed by photo-imaging and either chemical milling (etching) or additive techniques such as plating up or solder doming, and/or mechanical milling and/or precision die stamping techniques as will be described in detail hereinafter.

For a further understanding of the nature and objects of the present invention, reference should be had to the following detailed description taken in connection with the accompanying drawings wherein like numbers depict like parts and:

BRIEF DESCRIPTION OF THE DRAWINGS

FIG. 5 is a block flow diagram illustrating one process for producing the electrical switch assembly of FIG. 1;

FIGS. 6*a*–6*c* and 7 to 11 are top plan views of an electrical switch assembly at various stages of formation in accordance with the process of FIG. 5;

Figure 1:
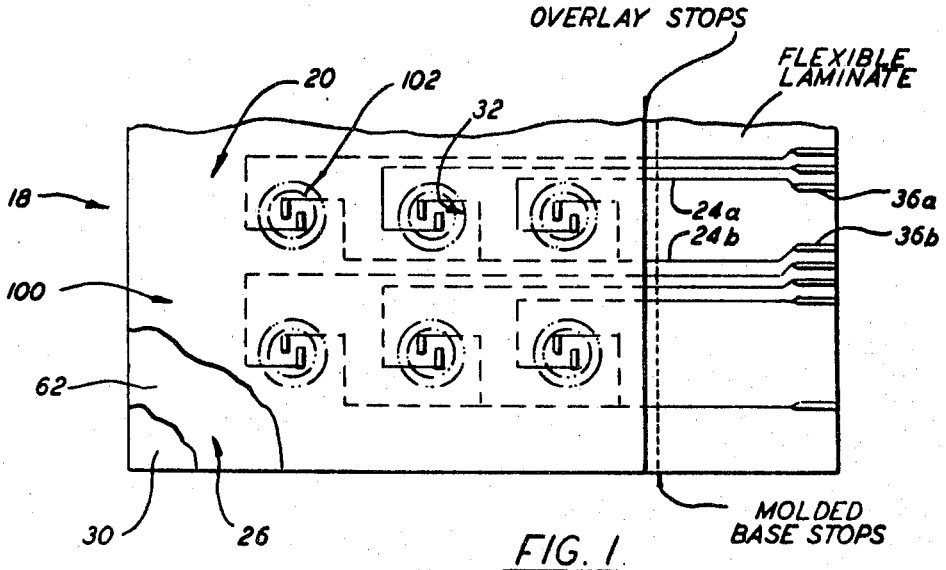
FIG. 1 is a top plan view of one form of electrical switch assembly constructed in accordance with the present invention, and incorporated in a keyboard.

As used herein the terms "left" and "right", "upper" and "lower", and "upwardly" and "downwardly", respectively, are used to denote relative direction solely with reference to the illustrations in the accompanying drawings. One skilled in the art will recognize, however, that in actual practice the switch assembly may be oriented other than as shown in the drawings.

DESCRIPTION OF THE PREFERRED EMBODIMENTS

One embodiment of electrical switch assembly in accordance with the present invention, assembled as a keyboard, is shown in FIGS. 1 to 4 of the drawings. In the embodiment of FIGS. 1 to 4 the keyboard, indicated generally at 18 comprises a flexible laminated circuit assembly 20 including a flexible dielectric film or base sheet 62 of conventional flexible printed circuit insulating material, e.g. 0.001 to 0.005 inch thick or more Mylar (available from E.I. DuPont de Nemours) and having a plurality of electrically conductive circuit pathways 24*a,b*, each formed of electrically conductive, flexible metal such as 0.0005 to 0.0010 inch thick or more supported copper adhesively fixed to surface 26 of base sheet 62. (Material thickness may vary over a wide range dependent on materials selection and switch size. As will become clear from the description following, as a general rule geometrically larger switches require heavier, i.e., thicker materials, while geometrically smaller switches require lighter, i.e., thinner materials.) The flexible circuit assembly 20 is formed by photoimaging and chemical milling (etching) techniques as will be described in detail hereinafter. (For convenience of illustration only a portion of circuit assembly 20 is shown in the drawings, and base sheet 62 has been omitted for clarity.) Alternatively circuit assembly 20 may comprise a flexible conductive material such as a screened silver filled epoxy supported on a flexible dielectric polymeric substrate, or the circuit assembly 20 may comprise a plurality of flexible insulating sheets and including one or more internally carried layers of conductive pathways. The conductive pathways have dimensions and shapes corresponding to desired design criteria, e.g. current carrying capacity and circuit and switch geometry.

The circuit assembly 20 is fixed in part to a rigid molded base member 30 as by adhesive means or by mechanical means as will be described in detail hereinafter. Base member 30 comprises a generally planar rigid body formed of electrically insulating material such as a glass filled thermoplastic polyester polymer, and has a plurality of cavities or blind holes 32 in predetermined locations corresponding to the desired location for the switch contacts 34 as will be described in detail hereinafter. Alternatively base member 30 may comprise a rigid board formed of electrically insulating material such as 0.062 inch thick phenolic resin board and having apertures or blind holes in the aforesaid predetermined locations.

Circuit pathways 24*a, b* . . . terminate at one end at bus members or contact fingers 36*a*, 36*b* . . . respectively and at their respective other ends at switch contacts 34. The latter are in normally open position. Each switch contact 34 comprises a first "left" contact member 40 which is an integral extension of pathway 24*b*, and a second "right" contact member 42 which is an integral extension of pathway 24*a*. Obviously bus members or contact fingers 36*a* and 36*b* provide an electrical connection to circuits (not shown) external of circuit assembly 20.

Figure 2:
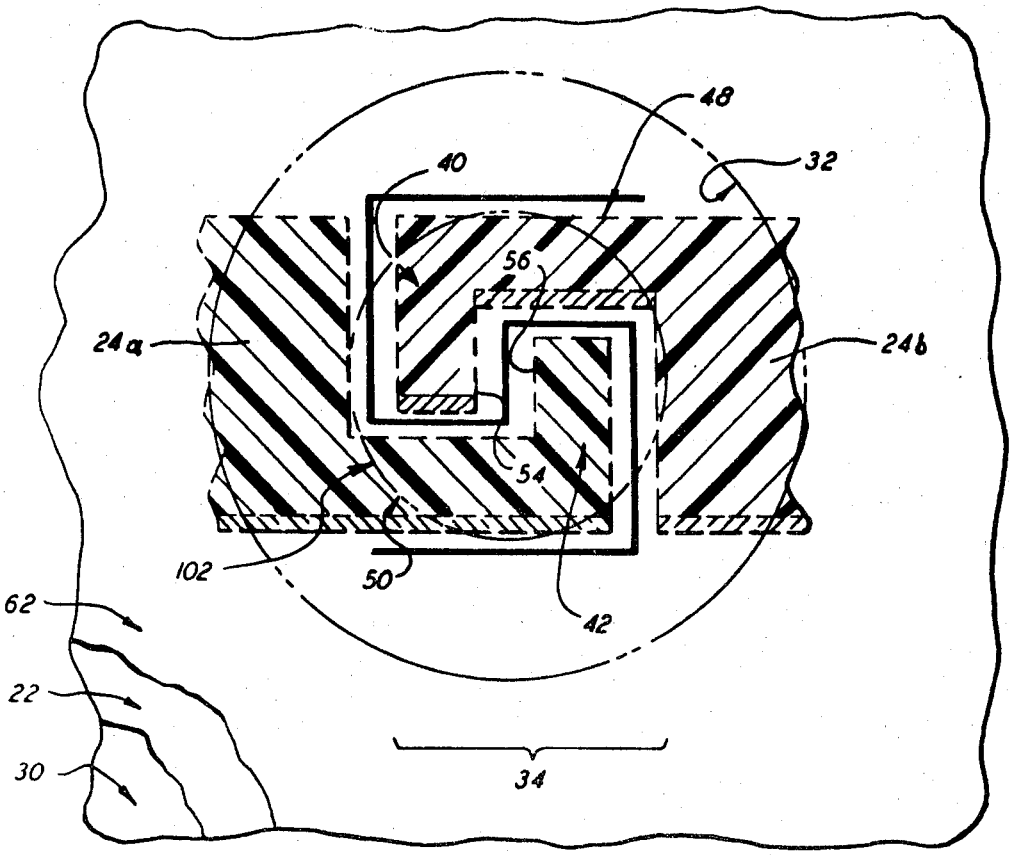
FIG. 2 is an enlarged top plan view of a portion of the electrical switch assembly of FIG. 1 at an intermediate stage of formation.
Figure 3A:
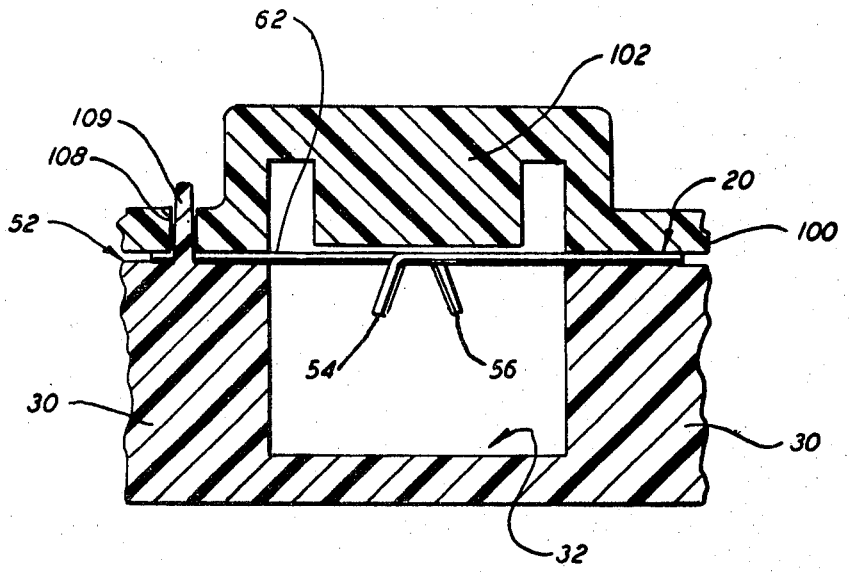
FIG. 3*a* is an enlarged side elevational view, partly in section, of the electrical switch assembly of FIG. 1; and showing the switch in open position.
Figure 3B:
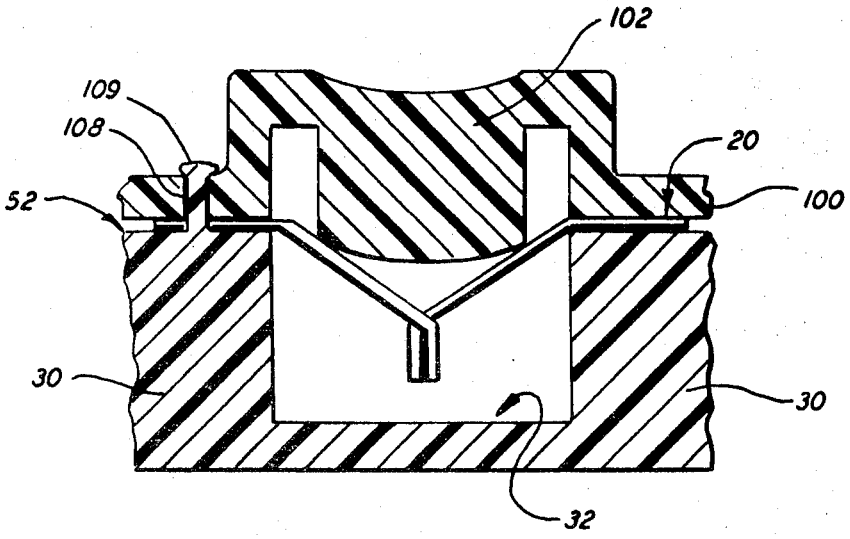
FIG. 3*b* is an enlarged side elevational view similar to FIG. 3*a*, and showing the switch in closed position.
Figure 4A:
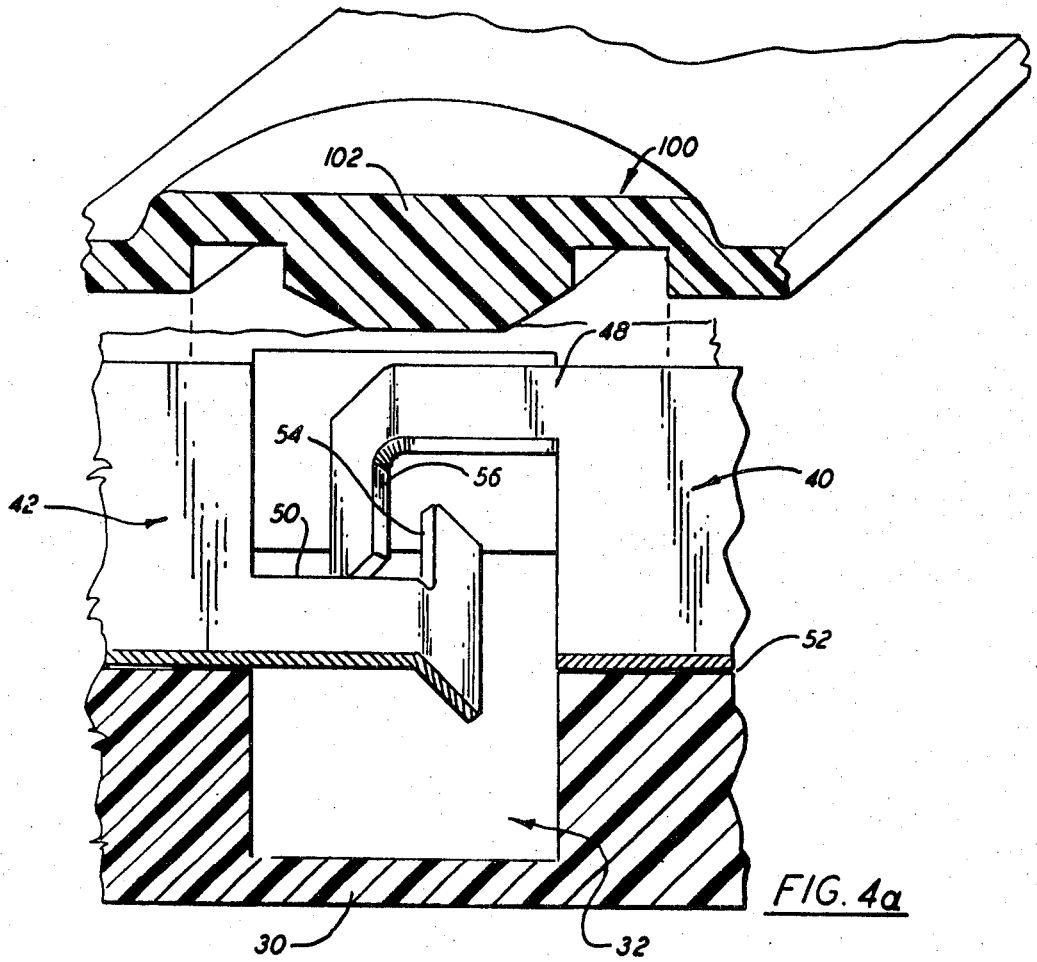
FIG. 4*a* is an enlarged geometric projection, partly in section, of a portion of the electrical switch assembly of FIG. 1, and showing the switch in open position.
Figure 4B:
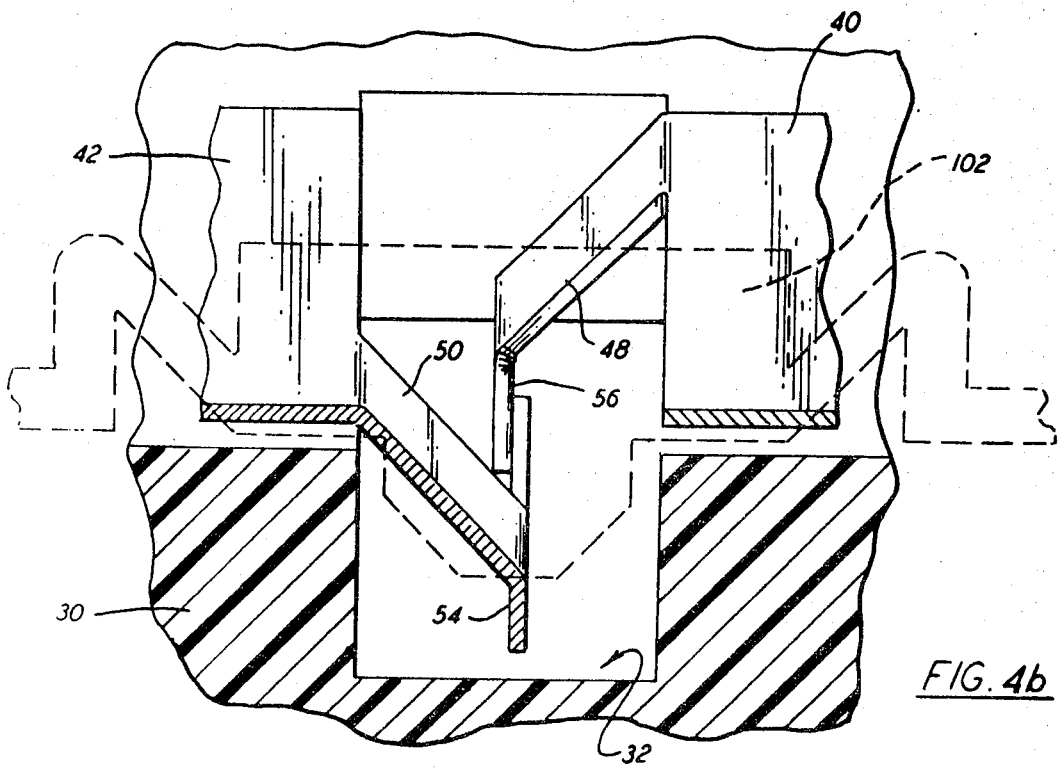
FIG. 4*b* is an enlarged geometric projection similar to FIG. 4*a*, and showing the switch in closed position.

Contact members 40 and 42 each constitute a generally L-shaped or golf club-like shaped member, the supporting beams or legs 48 and 50 of which are fixedly positioned at the edges of holes 32 to the top side surface 52 of base member 30. Supporting legs 48 and 50 extend across holes 32 for a distance beyond each other within their associated hole 32. As seen in FIG. 2 of the drawings supporting legs 48 and 50 are approximately of identical length. Alternatively, one leg may be longer than the other, if desired. The free ends 54 and 56 of members 40 and 42, respectively, are formed (deflected) at an angle of the plane of top side surface 52 and supporting legs 48 and 50, respectively, i.e., so as to extend downwardly at an angle from the plane of surface 52. Alternatively, free ends 54 and 56 may be formed (deflected) upwardly at an angle, to the plane of surface 52, i.e., as shown in FIGS. 16*a* and 16*b* or FIGS. 17*a* and 17*b*. As seen in FIG. 2, free ends 54 and 56 terminate a short distance from each other over or within their associated hole 32.

Completing the illustrated electrical switch assembly is a protective overlay covering 100 of flexible insulative sheet material which is fixedly positioned over the upper surface of circuit assembly 20. Preferably, but not necessarily, overlay covering 100 includes actuator elements 102 which are located to overlie the switch contact members' free ends 54 and 56 (see FIGS. 3 and 4. For convenience of illustration dielectric film 62 has been omitted from FIGS. 4*a* and 4*b*). Alternatively, the switch assembly may comprise actuator elements which are located to directly overlie the switch contact members' free ends 54 and 56, i.e., without any intervening overlay covering.

FIGS. 5 to 13 illustrate a preferred method of forming an electrical switch assembly in accordance with the present invention, employing photoimaging and chemical milling techniques for forming the circuit and switch patterns. It will be understood, however, that the circuit and/or switch patterns may be formed employing additive techniques, e.g. plating up, mechanical stamping techniques, screening on of conductive inks such as metal filled epoxy, or using formed, i.e. shaped wires or conductors.

A resiliently flexible laminated sheet material 60 comprising a thin metal film or foil 64 such as 0.0005 inch thick copper adhered to an adhesive coated polymeric film substrate such as 0.005 inch thick Mylar 62 (Trademark of E. I. DuPont de Nemours for polyester film) is provided as shown in FIG. 6*a*. The top, i.e. metal film surface 64 of laminated sheet 60 is then cleaned employing conventional cleaning techniques, and the cleansed surface is then coated at a coating station 68 (FIG. 5) with conventional resist layer 70 as shown in FIG. 6*b*. A positive resist is preferred so that multiple imaging and developing stages may be employed as will become clear from the description following. Various positive resists are known in the art and are available commercially. For the purposes of this example AZ type positive resist available from the Shipley Co., Newton, Mass., is used. Resist layer 70 then is exposed to light, at an imaging station 72 to a positive art work image of the circuit pathways and contacts 40 and 42. Those areas 70*a* (FIG. 6*c*) of the resist exposed to light are altered and removed from the sheet in a later developing operation. The laminate is then immersed in a preferential solvent for the resist (e.g., sodium hydroxide solution), and developed at a treating station 73, with the result that the exposed portions of resist layer 70*a* are dissolved leaving resist layer 70*b* in a positive image of the circuit pathways and switch contacts overall plan, i.e. as shown in FIG. 7.

The next step in the process involves chemically milling the exposed metallic areas of metal foil 64 by contacting the laminated sheet with an acid etching solution at an etching station 74. Etching removes metal from all the uncovered areas of the metal film, leaving the areas of metal film covered by the resist intact (see FIG. 8).

The next step in the process involves selectively re-exposing and developing the resist so as to expose selected areas 75 of the resist layer 70, which areas subsequently become the switch contact free ends 54 and 56 (see FIG. 2) to light, at imaging station 72. Those areas of the resist layer 70 exposed to light are altered as before, and removed from the sheet by immersing the sheet in a preferential solvent and developing at treating station 73, with the result that the exposed portions of resist layer 70 are dissolved to expose metallic areas 75 of foil 64, and leaving resist layer 70 intact as a protective coating on the circuit pathways and contact supporting legs 48 and 50 (see FIG. 9).

Figure 10:
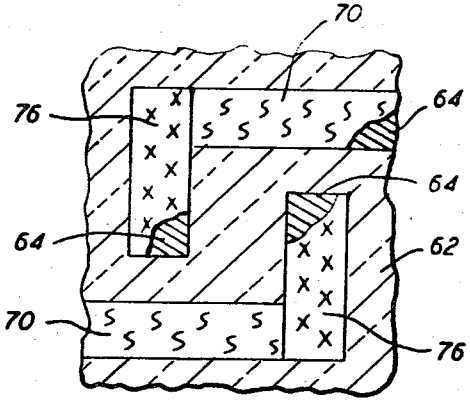
Figure 9:
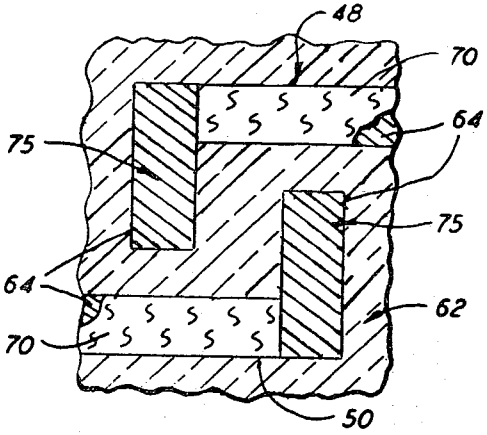
Figure 8:
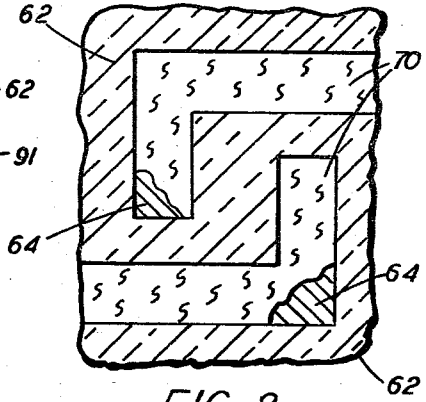

The next step involves forming raised areas by plating the exposed metallic areas 75 of foil 64 by a conventional plating technique, e.g., electrodeposition, in known manner, with a non-corrosive metal 76 at a plating station 79. Mylar film 62 effectively masks the entire bottom surface of circuit pathways and contacts 40 and 42 while resist areas 70 effectively mask the entire top surface of the metal foil (other than exposed areas 75), so that electrodeposition of metal is selectively restricted to those areas of the switch contacts which ultimately will become the actual contact areas of the switches. As a result plating the switch contacts thus is an especially simple procedure, and one which may result in relatively low metal consumption in the plating operation. The resulting structure is shown in FIG. 10.

Figure 11:
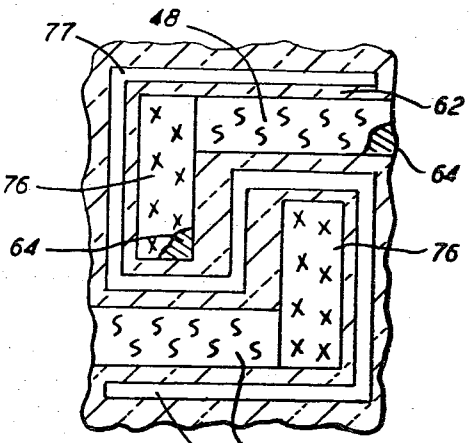
Figure 13:
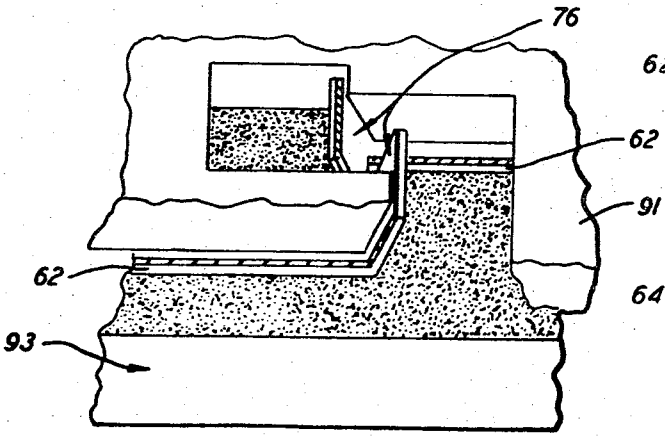
FIG. 13 is an enlarged geometric projection, partly in section, of a portion of the electrical switch assembly at the FIG. 12 stage of formation in accordance with the process of FIG. 5.

The next steps in the process involve cutting and shaping (forming) the actual switch contacts. Cutting and shaping may be accomplished either in a single precision die cutting and shaping step in cutting and forming station 92, or in separate cutting and shaping steps. For convenience of illustration the cutting and shaping steps are described as two separate steps. In the first step the Mylar substrate 62, plated areas 76 and legs 48 and 50 are cut free at 77 in known manner, by means of a steel rule die, to outline plated areas 76 and legs 48 and 50. The resulting structure is as shown in FIG. 11. In the second step plated areas 76 of the contact members are shaped or formed (deflected) permanently upwardly from the plane of surface 62 as shown by heat forming and cooling the cut free plated areas 76 under pressure using a heated steel ruled die and mating anvil (see FIGS. 12 and 13) or by vacuum forming techniques as are known per se in the art. (For convenience of illustration FIG. 13 shows the structure in inverted oblique view.) In this step, plated areas 76 are shaped or deflected so as to extend at an angle, preferably in the range of 45° to 115°, as measured from the plane of surface 62, and the deflection is permanently set in the Mylar film by heat forming or other known means, whereby to form shaped free ends 54 and 56 (see FIGS. 2 and 3). By way of example, as shown in FIG. 13, plated areas 76 may be located over a suitably dimensioned template 91 (metallic area to template), covered with a silicon rubber pad 93, and pressure and heat (150° F.) applied to the silicon pad for sufficient time to permanently set the captured Mylar layer 62. Deflection is controlled so that the closest edges of free ends 54 and 56 are located a short distance from one another, for example, to provide a 0.010 to 0.025 inch spacing between the free ends 54 and 56. Obviously, the spacing between free ends 54 and 56 is a matter of design choice and may be adjusted for a particular application.

Figure 12:
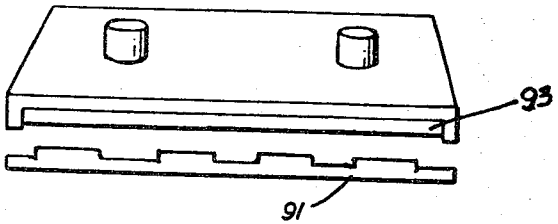
FIG. 12 is a geometric projection of a forming tool useful in the process of FIG. 5.

Thereafter, the structure resulting from FIGS. 12 and 13 is secured at a mounting station 90 to rigid apertured panel or molded base member 30 with the severed free ends 54 and 56 centered over the geometric centers of the panel cavities or holes 32. Obviously cavities or holes 32 are in a predefined pattern in accordance with the particular switch pattern.

The final step involves covering the resulting switch structure with a flexible dielectric overlay covering 100. Overlay covering 100 preferably includes actuator elements 102 in the form of curved, disc-shaped resiliently flexible members such as molded key caps or domes or the like which are located to overlie the switch contacts. Actuator elements 102 preferably but not necessarily are formed integrally with overlay covering 100. Overlay covering 100 may be adhesively fixed to the switch assembly along the edges thereof so as to provide a sealed unit. Alternatively, overlay covering 100, base member 30 and circuit board assembly 20 may be mechanically joined as a unit, as by heat swaging suitably located locking posts 109. Locking posts 109, which may be molded integrally with base member 30, are located to mate with and extend through suitable located apertures 108 in circuit board assembly 20 and overlay covering 100, respectively. (See FIGS. 3*a* and 3*b* in which a locking post 109 is illustrated prior to and following swaging). One skilled in the art will recognize that the provision of posts and mating apertures permits simple and reliable registration of the switch assembly.

The resulting structure is as shown in FIGS. 1 to 4 of the drawings.

One skilled in the art will recognize a number of advantages of the present invention over prior art switches. For one, the switches and supporting electrical circuits may be formed by simple photo-imaging and etching techiques, and a simple mechanical die cutting and forming operation. Moreover, the switch assembly may have virtually unlimited geometric design. The switch assembly has few parts, and assembly alignment problems normally associated with prior art switches essentially are eliminated. Additionally, switch throw and switch spring constant are dependent on readily modified variables including aperture size, actuator geometry and selection of materials employed. Moreover, the invention provides particular manufacturing advantages of simple assembly techniques, and high field use reliability since the switch contact areas can be plated with precious metal (e.g. gold) at minimum materials cost. Additionally, the natural motion of the switch provides a wiping action of the switch contact surfaces whereby to remove any oxidation which may form on the switch, and thus increase switch reliability.

Figure 14:
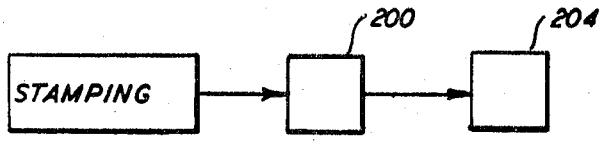
FIG. 14 is a block flow diagram illustrating an alternative process for producing the electrical switch assembly of the present invention.
Figure 15A:
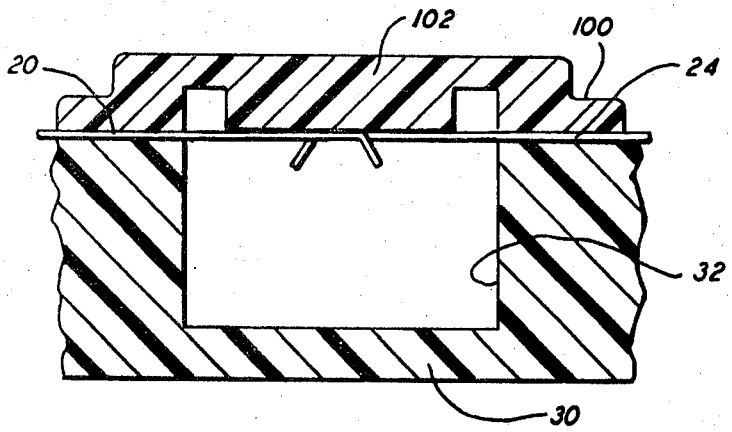
FIG. 15*a* is an enlarged side elevational view, partly in section, showing one alternative form of electrical switch assembly made in accordance with the present invention, and showing the switch in open position.
Figure 15B:
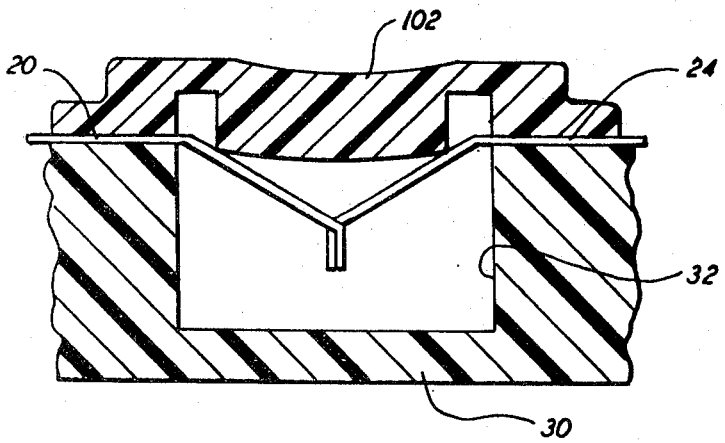
FIG. 15*b* is an enlarged side elevational view, similar to FIG. 15*a*, and showing the one alternative form of electrical switch assembly according to the present invention in closed position.

The aforesaid invention is susceptible to modification. Thus, for example as shown in FIG. 14, the desired circuit and switch pattern may be produced by stamping or cutting the circuit and switch pattern directly from an unsupported spring metal sheet such as 0.005 inch thick phosphor bronze. The switch contacts may then be shaped in a precision die stamping station 200, with the spring metal itself taking permanent set. Alternatively, the circuit cutting and shaping operation may be combined in a single step. The resulting structure may then be assembled, at a mounting station 204, to suitably provide molded base member 30 and covering 100 as before. The resulting structure is as shown in FIGS. 15*a* and 15*b* which illustrate the resulting switch contact in open and closed positions, respectively. A particular feature and advantage of the procedure of FIG. 14 is that keyboard or other switch assemblies having regularly positioned switches can be manufactured quite inexpensively by a simple stamping operation. Moreover, by using strip-plated laminate as the starting metallic sheet material and employing suitable circuit/switch design low cost switches with plated contacts may be produced. Strip plated laminate is available commercially in various weights and dimensions.

Figure 16B:
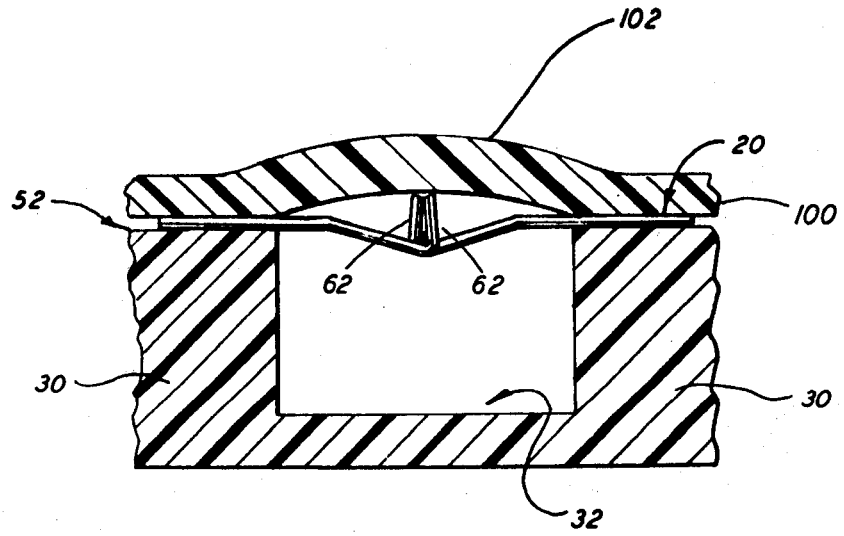
FIG. 16*b* is an enlarged side elevational view similar to FIG. 16*a*, and showing the other alternative form of electrical switch assembly according to the present invention in closed position.
Figure 16A:
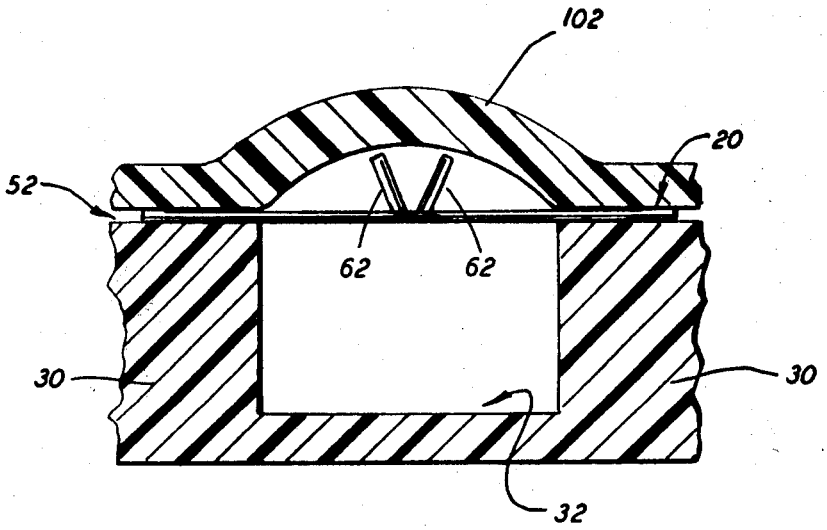
FIG. 16*a* is an enlarged side elevational view, partly in section, of another alternative form of electrical switch assembly according to the present invention, and showing the switch in open position.
Figure 17A:
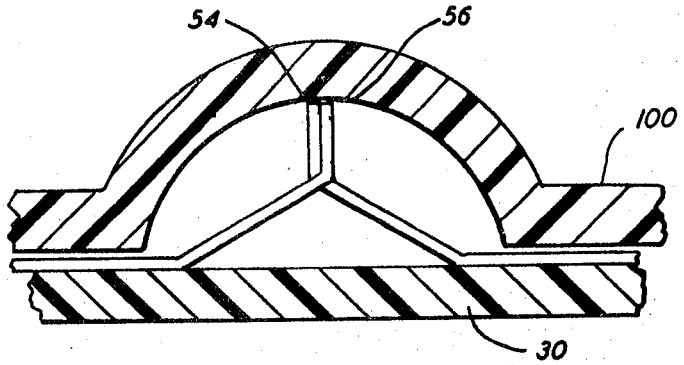
FIG. 17*a* is an enlarged side elevational view, partly in section, of still another alternative form of electrical switch assembly according to the present invention, and showing the switch in closed position.
Figure 17B:
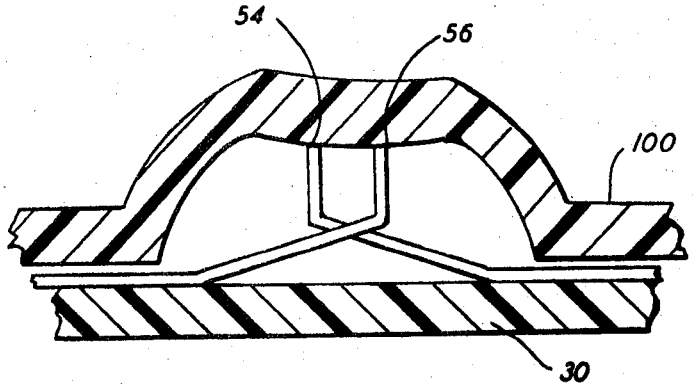
FIG. 17*b* is an enlarged side elevational view, similar to FIG. 17*a*, and showing the still another alternative form of electrical switch assembly according to the present invention, in open position.

Moreover, as shown in FIGS. 16*a* and 16*b*, switch contact free ends 54 and 56 may be formed upwardly (relative to surface 52), i.e., toward actuator element 102. In still another modification as shown in FIG. 17*a*, the switch contact free ends 54 and 56 extend upwardly from the face of base member 30 in normally closed position. Actuation of such switches will result in switch opening as shown in FIG. 17*b*. Note in FIGS. 17*a* and 17*b* the switch contacts are formed upwardly from molded base 30 into a molded bubble formed in a dielectric cover member 100. (In the FIGS. 17*a* and 17*b* embodiment dielectric cover member 100 constitutes the "carrier panel" while the molded bubble constitutes the "cavity" for accommodating the switch contacts in accordance with the present invention.) A particular advantage of the switch modification of FIGS. 17*a* and 17*b* is that the switch may be made especially thin in cross-section. Moreover, base member 30 need not be generally planar as shown, but may be made rounded, at least in part.

Figure 18A:
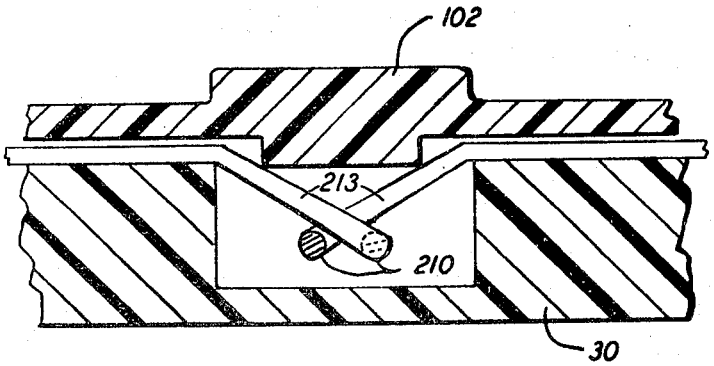
FIG. 18*a* is an enlarged side elevational view, partly in section, of yet another alternative form of electrical switch assembly according to the present invention, and showing the switch in open position.
Figure 18B:
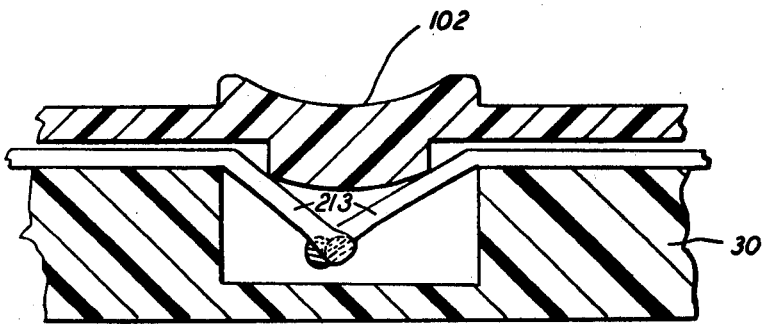
FIG. 18*b* is an enlarged side elevational view similar to FIG. 18*a*, and showing the still another alternative form of electrical switch assembly in closed position.

In still another modification as shown in FIGS. 18*a* and 18*b*, the switch contacts comprise L-shaped (formed) spring wires 213 which are plated at the free ends thereof, i.e. at 210. With this latter embodiment the heat forming operation may be eliminated.

Figure 19A:
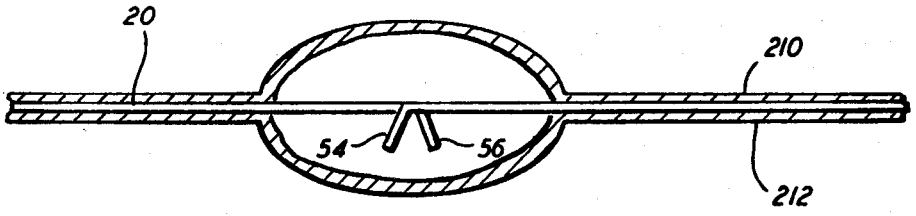
FIG. 19*a* is an enlarged geometric projection, partly in section, of still yet another form of electrical switch assembly according to the present invention, and showing the switch in open position.
Figure 19B:
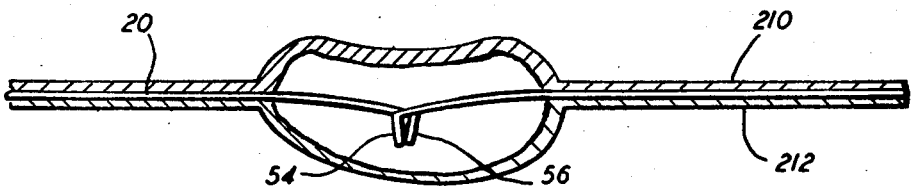
FIG. 19*b* is an enlarged geometric projection similar to FIG. 19*a*, and showing the switch in closed position.

In yet another embodiment of the invention, shown in FIGS. 19*a* and 19*b*, the switch contacts and associated circuitry are sandwiched between a pair of flexible dielectric polymer bubbled sheets 210 and 212. Operation of the switch is as above described. Still other changes will be obvious to one skilled in the art. Thus, switches other than keyboard switches, for example, rotary type switches or dual-in-line package type switches (so-called DIP switches) advantageously may be produced using the teachings of the present invention. It is therefore intended that all matter contained in the above description shall be interpreted in an illustrative and not in a limiting sense.

I claim:

1. A method of fabricating an electrical switch assembly comprising a dielectric substrate having at least one cavity formed in one face of said substrate, and one or more electrically conductive circuits formed of resiliently flexible conductive material fixed in part to said dielectric substrate, each of said electrically conductive circuits having an array of switch means, each said switch means comprising a pair of contact members overlying said cavity, said pair of contact members comprising (a) integral extensions of such said conductive circuits and including (b) a pair of generally L-shaped fingers (1) disposed inwardly for a distance and (2) cantilevered from the edge of their associated cavity, said L-shaped fingers occupying the same plane adjacent the edge of their associated cavity, extending beyond the geometric center of said associated cavity, and extending, in part, above or below the plane of said one face; said method comprising the steps of:

(a) providing a resiliently flexible electrically conductive sheet;

(b) removing material from areas of said electrically conductive sheet while leaving a pattern of conductors and said contact members but continuous to one another;

(c) severing the continuous contact members to form said L-shaped fingers;

(d) permanently deforming said L-shaped fingers at least in part;

(e) providing a dielectric substrate having cavities at predetermined locations in one surface thereof; and (f) fixedly positioning said pattern of conductors and L-shaped fingers resulting from step (d) relative to said one surface of the dielectric panel, with said L-shaped fingers positioned at least in part overlying said cavities.

2. A method according to claim 1, wherein said material is removed from selected areas of said electrically conductive sheet by chemical milling.

3. A method according to claim 1, wherein said material is removed from selective areas of said electrically conductive sheet by precision die stamping.

4. A method according to any one of claims 1, 2 or 3, wherein said L-shaped fingers are permanently deformed by heat forming.

5. A method according to claim 1, wherein said electrically conductive sheet comprises a laminate of a metallic foil and a polymeric substrate material underlying said metallic foil, and including the step of permanently deforming said L-shaped fingers by heat forming portions of said substrate underlying said fingers.

6. A method according to claim 1, wherein said electrically conductive sheet comprises unsupported metallic sheet, and including the step of permanently deforming said L-shaped fingers by forming the metal under pressure.

7. A method according to any one of claims 1, 5 or 6, and wherein said severing step (c) and said deforming step (d) are accomplished in a single stamping and forming operation.

8. A method according to claim 1, including the step of covering the structure resulting from step (f) with a flexible dielectric overlay.

9. A method of fabricating an electrical switch assembly comprising a carrier substrate having at least one cavity formed in one face of said substrate, and one or more electrically conductive circuits formed of resiliently flexible conductive material fixed in part to said carrier substrate, each of said electrically conductive circuits having an array of switch means, each said switch means comprising a pair of contact members overlying said cavity, said pair of contact members comprising (a) integral extensions of such said conductive circuits and including (b) a pair of generally L-shaped fingers (1) disposed inwardly for a distance and (2) cantilevered from the edge of their associated cavity, said L-shaped fingers occupying the same plane adjacent the edge of their associated cavity, extending beyond the geometric center of said associated cavity, and extending, in part, above or below the plane of said one face; said method comprising the steps of:

(a) providing a resiliently flexible circuit panel having an electrically conductive pattern in the form of said electrically conductive circuit and said contact members but continuous to one another;
(b) severing the continuous contact members to form said L-shaped fingers;
(c) depositing electrically conductive material onto selected areas of said L-shaped fingers so as to produce raised areas thereon;
(d) providing a dielectrical panel having cavities at predetermined locations in one surface thereof; and
(e) fixedly positioning the pattern of conductors and L-shaped fingers resulting from step (c) onto said one surface of said dielectric panel, with said raised areas of said L-shaped fingers positioned at least in part overlying said cavities.

10. A method according to claim 9 wherein said raised areas comprise metal deposited by plating-up.

11. A method according to claim 9 wherein said raised areas comprise metal deposited by solder doming.

12. A method according to claim 9 and including the step of covering the structure resulting from step (e) with a flexible dielectric overlay.

13. A method according to claim 9 wherein said electrically conductive pattern is formed by additive techniques.

14. A method according to claim 13, wherein said material is removed from areas of said electrically conductive sheet by precision die stamping.

15. A method according to claim 13, wherein said electrically conductive sheet comprises a laminate of a metallic foil and a polymeric substrate material underlying said metallic foil, and including the step of permanently deforming said L-shaped fingers by heat forming portions of said polymeric substrate underlying said fingers.

16. A method according to claim 13, wherein said electrically conductive sheet comprises unsupported metallic sheet, and including the step of permanently deforming said L-shaped fingers by forming the metal under pressure.

17. A method according to claim 13, including the step of covering the structure resulting from step (f) with a flexible dielectric overlay.

18. A method according to any one of claims 13 or 15, and wherein said severing step (c) and said deforming step (d) are accomplished in a single stamping and forming operation.

19. A method of fabricating an electrical switch assembly comprising a dielectric substrate having at least one cavity formed in one face of said substrate, and one or more electrically conductive circuits formed of resiliently flexible conductive material fixed in part to said dielectric substrate, each of said electrically conductive circuits having an array of switch means, each of said switch means comprising a pair of contact members overlying said cavity, said pair of contact members comprising (a) integral extensions of said conductive circuits and including (b) a pair of generally L-shaped fingers (1) disposed inwardly for a distance and (2) cantilevered from the edge of their associated cavity, said L-shaped fingers occupying the same plane adjacent the edge of their associated cavity, extending beyond the geometric center of said associated cavity, and extending, in part, above or below the plane of said one face; said method comprising the steps of:

(a) providing a resiliently flexible electrically conductive sheet;
(b) removing material from areas of said electrically conductive sheet while leaving a pattern of the conductors and said contact members but continuous to one another;
(c) severing the continuous contact members to form said L-shaped fingers;
(d) permanently deforming said L-shaped fingers at least in part;
(e) providing dielectric substrate having cavities at predetermined locations in one surface thereof; and
(f) fixedly positioning said pattern of conductors and L-shaped fingers resulting from step (d) relative to said one surface of said dielectric substrate, with said L-shaped fingers positioned at least in part within said cavities.

20. A method according to claim 19, wherein said material is removed from areas of said electrically conductive sheet by chemical milling.

21. A method according to any one of claims 13, 19 or 20, wherein said L-shaped fingers are permanently deformed by heat forming.

22. A method according to claim 21, wherein said severing step (c) and said deforming step (d) are accomplished in a single stamping and forming operation.

23. A method of fabricating an electrical switch assembly comprising a carrier substrate having at least one cavity formed in one face of said substrate, and one or more electrically conductive circuits formed of resiliently flexible conductive material fixed in part to said carrier substrate, each of said electrically conductive circuits having an array of switch means, each of said switch means comprising a pair of contact members overlying said cavity, said pair of contact members comprising (a) integral extensions of such said conductive circuits and including (b) a pair of generally L-shaped fingers (1) disposed inwardly for a distance and (2) cantilevered from the edge of their associated cavity, said L-shaped fingers occupying the same plane adjacent the edge of their associated cavity, extending beyond the geometric center of said associated cavity, and extending, in part, above or below the plane of said one face; said method comprising the steps of:

(a) providing a resiliently flexible circuit panel having an electrically conductive pattern in the form of said electrically conductive circuit and said contact members but continuous to one another;
(b) severing the continuous contact members to form said L-shaped fingers;
(c) depositing electrically conductive material onto selected areas of said L-shaped fingers so as to produce raised areas thereon;
(d) providing a dielectrical panel having cavities at predetermined locations in one surface thereof; and
(e) fixedly positioning the pattern of conductors and L-shaped fingers resulting from step (c) onto said one surface of said dielectric panel, with said raised areas of said L-shaped fingers positioned at least in part within said cavities.

24. A method according to claim 23, wherein said raised areas are formed by plating-up metal.

25. A method according to claim 23, wherein said raised areas are formed by solder doming.

26. A method according to claim 25, and including the step of covering the structure resulting from step (e) with a flexible dielectric overlay.

27. A method according to claim 23, wherein said conductive pattern is formed by additive techniques.

* * * * *